US005662225A

United States Patent [19]

DeMatteis

[11] Patent Number: 5,662,225

[45] Date of Patent: Sep. 2, 1997

[54] T-SHIRT BAG AND RACK COMBINATION

[76] Inventor: Robert B. DeMatteis, 1668 Mill Stream Dr., Chino Hills, Calif. 91709

[21] Appl. No.: 626,293

[22] Filed: Apr. 1, 1996

Related U.S. Application Data

[63] Continuation-in-part of Ser. No. 351,629, Dec. 8, 1994, abandoned.

[51] Int. Cl.[6] ..... B65D 33/14; A63B 55/04; B65B 67/04

[52] U.S. Cl. ..... 206/554; 248/97; 248/99; 383/9

[58] Field of Search ..... 206/554; 383/8, 383/9, 37; 248/97, 99, 100

[56] References Cited

U.S. PATENT DOCUMENTS

| | | | |
|---|---|---|---|
| Re. 33,264 | 7/1990 | Baxley et al. | 206/554 |
| 4,529,090 | 7/1985 | Pilow | 206/554 |
| 4,676,378 | 6/1987 | Baxley et al. | 206/554 |
| 4,981,216 | 1/1991 | Wilfong, Jr. | 206/554 |
| 4,995,860 | 2/1991 | Wilfong, Jr. | 206/554 X |
| 5,188,235 | 2/1993 | Pierce et al. | 206/554 |
| 5,307,935 | 5/1994 | Kemanjian | 206/554 |
| 5,335,788 | 8/1994 | Beasley et al. | 206/554 |
| 5,363,965 | 11/1994 | Nguyen | 206/554 |
| 5,469,969 | 11/1995 | Huang | 206/554 |
| 5,469,970 | 11/1995 | Li | 206/554 |

FOREIGN PATENT DOCUMENTS

| | | | |
|---|---|---|---|
| 2710150 | 9/1978 | Germany | 206/554 |

*Primary Examiner*—Bryon P. Gehman
*Attorney, Agent, or Firm*—Beehler & Pavitt

[57] ABSTRACT

A rack and bag combination in which rack is provided with a pair of parallel rods spaced apart from each other extending outwardly from a transverse support member and between which is disposed an upwardly extending hooking element. A pack of plastic T-shirt type bags is provided for mounting on the rods and hooking element of the rack, each bag having slotted central detachable portions extending downwardly from the inner edges defining the bag mouth, the detachable portions being formed by a series of scalloped cuts joined to adjacent cuts by small bridges with the cuts directed so that when the portions are detached, any tearing will extend into the detachable portions and away from the bag wall. Orifices are provided in the sides of the bags for mounting on the rods while the detachable portions are disposed on the upwardly extending hooking element with the result that the bag mouth is raised and may be opened more widely for filling with articles.

6 Claims, 2 Drawing Sheets

Fig. 1A
PRIOR ART
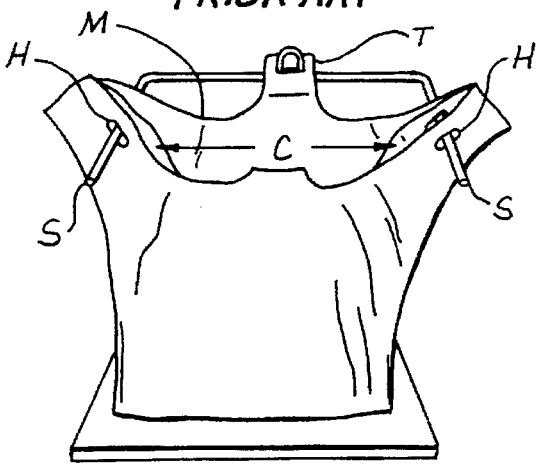
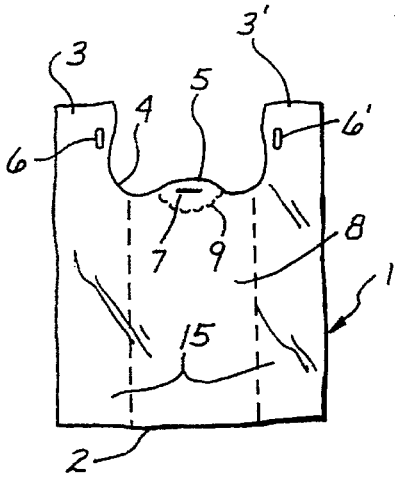
Fig. 1
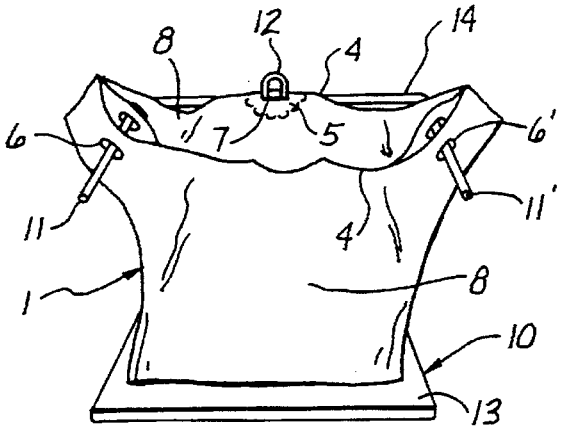
Fig. 2
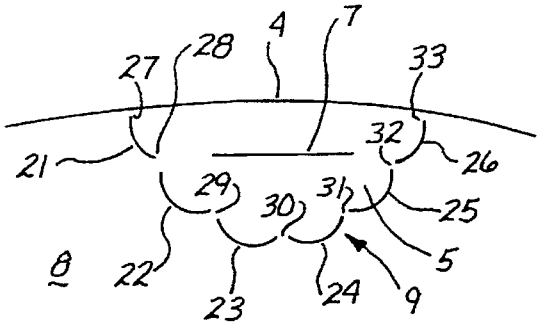
Fig. 3

T-SHIRT BAG AND RACK COMBINATION

This is a continuation-in-part application Ser. No. 08/351,629 filed Dec. 8, 1994, which is abandoned.

FIELD OF THE INVENTION

This invention relates to plastic sacks commonly used in supermarket, drug and discount stores in food and related trades, to carry merchandise from the store to home. More specifically, this invention relates to a plastic sack style and system that can be used to substantially improve load capacity and loading efficiency.

BACKGROUND OF THE INVENTION

Plastic sacks have become the most popular style of bag to carry merchandise and their related loading systems are preferred in high volume outlets in North America and in much of Europe, Australia and Asia. In these high volume outlets, the systems incorporate a rack style holder which supports packs of thin gauged bags while a user loads the bags and removes the filled bags from the holder.

Being able to fill up plastic sacks by utilizing as much of the entire bag capacity as possible is important in high volume outlets. If the capacity is not properly utilized, i.e. underutilized, more bags will be used, thereby increasing both bag and labor costs. A system that utilizes as much of the available capacity in a plastic sack as possible can represent an important cost-cutting measure.

DESCRIPTION OF THE PRIOR ART

Among more popular systems in use in the world today in high volume outlets is that described in U.S. Re. Pat. No. 33,264 and earlier related patents. Plastic sacks of this variety have a centrally located detachable tab that extends upwardly from the bag mouth, and holes intermediately located in each handle. These bags are generally provided in unitary packs of 50 or 100 bags. The unitary pack is mounted onto a rack style holder by threading the two sets of handle holes onto two rod supports spaced laterally from each other, and placing the centrally located upwardly extending detachable apertured tab onto a centrally located projecting element.

The projecting element holds the bag pack in place while the forward-most bag is being utilized. To prepare for utilization, the user separates the front wall of the forward-most bag and pulls it forward, while the bag is being supported by the rod supports which have been inserted through the handle holes, and the rear bag wall is being retained by the centrally located tab mounted onto the projecting element. The user then loads the bag in this supported position. As disclosed in U.S. Pat. No. 4,529,090, tearing of the bag body upon separation of the bag walls from the tab can be avoided by utilizing detachable joinder sections located adjacent the bag mouth.

A problem associated with this prior art system is that when bags are mounted on the rack style holder, they hang down to an undesirable extent. This is confirmed by the fact that the upwardly extending tab which is hooked on the projecting element forces the bag mouth to be below the top of the rack style holder. It is further compounded by the fact that the plastic sack handles are generally 6" long and, upon mounting the intermediate handle holes onto the holder's rod supports, the bag and the bag mouth are caused to hang down even to a greater extent.

Further, in order to open up the bag mouth to a sufficient width so a user can commence loading the bag, the rod supports must be spread outwards, beyond the normal distance spanning the handle holes. Thus, the handle holes mounted on the rod supports cause the handles to be stretched outwards about 11–12", with the handles pointing away from the center, whereas the handle holes on a bag in a lay-flat position are usually spaced about 7–7½" apart and 3" above the bag mouth.

The result, upon opening the forward-most bag, is a bag and its mouth hanging down below the rod supports, well below the top of the rack style holder and, with a relatively narrow, oblong shaped, open-mouth configuration. Such hanging bag actually resists squaring itself out due to being forced to take on this unnatural, oblong configuration. This narrow oblong configuration generally causes the user to underutilize the actual capacity of the plastic sack.

As illustrated in the PRIOR ART FIG. 1A of the drawings, the upwardly extending tab T determines where the central region of the bag mouth M will be situated on the rack style holder in its lowered position. The lower portion of the bag mouth may be seen to be further determined by intermediate handle holes H mounted onto rod supports S. Such mounting causes the bag to hang downward below the rod supports S on the rack style holder. The result is the oblong configuration C of bag mouth M.

SUMMARY OF THE INVENTION

The plastic sack and rack mounting system of the present invention increases the ability of the user to utilize the sack's entire capacity. When the plastic sack of the present invention is placed on a rack style holder and opened up, it utilizes more of bag system's cube for loading than is possible with prior art systems.

This is accomplished by a unique design which lifts the sack high onto its rack holder and allows the bag mouth to be opened more widely. In fact, the bag mouth actually opens up to a configuration which defines a greater area than the original bag dimensions would indicate to be possible. For instance, a plastic grocery sack which typically measures 12" across by 7" wide has an open mouth area of 84" square (12" times 7"); whereas this same sized bag in the form of the present invention can take on a squared out configuration of 9.5" across by 9.5" wide (9.5" times 9.5") or an open mouth area of 90.25" square.

Instead of an upwardly extending detachable tab, the bag pack of the present invention is retained on the rack style holder by providing a transverse slit on a centrally located detachable portion of the bag body wall, said slit being located below the portions of the body wall immediately adjacent the centrally located detachable portion, the upper edge of which detachable portion, together with the upper edges of adjacent body wall portion define the bag mouth. A retaining means, such as an upwardly extending element is passed through said slit when the bag is mounted on the rack style holder. When the detachable portion is disposed on the central retaining means of the rack holder, the central part of the bag body is actually lifted up and the bag mouth is disposed at approximately the top of the rack holder instead of hanging down below it as is prior art systems. The outer regions of the bag body and mouth are also lifted up high onto the rack holder by providing two laterally spaced apertures in the sides of the bag body and passing the rod supports through such apertures. These two spaced apertures in the body are normal to the plane of the centrally located detachable portion and may be disposed near the outside edges of the plastic sack. They may be cut through the side gussets as well. When the apertures are placed onto the rod supports of the rack holder and the centrally located detachable portion is secured on the central retaining means, the result is a plastic sack which sits high up on the rack holder, and, when opened by the user, squares itself out naturally along the rod supports.

The lifting up of the bag walls and the squaring out effect increases the area of the open bag mouth substantially, and can result in the ability of the user to load up to 20 to 30% more merchandise in each sack. When the sack is fully loaded, it is then a simple operation to locate and grasp the handles which lay atop the rod supports, and to remove the loaded sack from the rack holder. Thus, the plastic sack of the present invention lends itself to being loaded more fully and more easily, and is simple to use.

BRIEF DESCRIPTION OF THE DRAWINGS

FIG. 1A is a front perspective view of a prior art rack and such combination.

FIG. 1 is a plan view of one type of bag of the present invention showing its centrally located detachable portion and rod receiving orifices.

FIG. 2 is a front perspective view of the bag of FIG. 1 mounted onto a rack holder.

FIG. 3 is an enlarged plan view of the centrally detachable portion of the present invention.

DETAILED DESCRIPTION OF THE PREFERRED EMBODIMENTS

Figure 4:
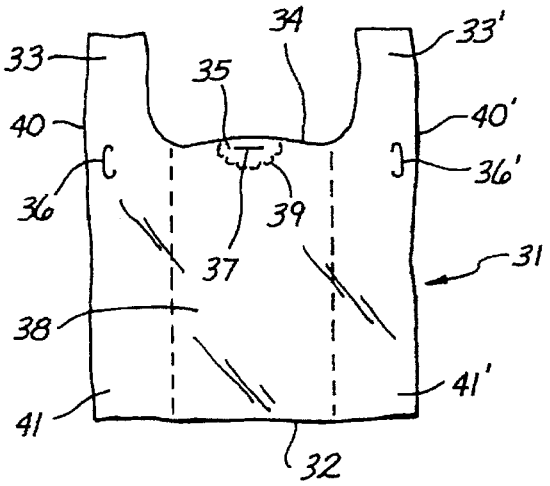
FIG. 4. is a plan view of the preferred version of the present invention with its centrally located detachable portion and apertures in the bag's body.

Referring to FIG. 1, plastic bag 1 has a bottom 2, two handles 3 and 3', a bag mouth 4, a body 8, and side gusset panels 15. Bag mouth 4 extends substantially horizontal from the base of handle 3 to the base of handle 3'. Centrally located below bag mouth 4 in body 8 is a detachable portion 5, which has a transverse slit 7 within its perimeter, said slit 7 also thereby being located below mouth 4. This perimeter is defined by perforation line 9 in the bag body 8 and a center portion of bag mouth 4. Handles 3 and 3' have handle holes 6 and 6' intermediately spaced along the handle's length.

As illustrated in FIG. 2, rack holder 10 has two rod supports 11 and 11', a central retaining element 12 and a base 13. Rod supports 11 and 11' are connected along the back side of rack holder 10 by brace 14, which generally, together with said rod supports 11, 11', represents the top of rack holder 10. Bag 1 is mounted on the rack holder 10 by passing handle holes 6 and 6' onto rod supports 11 and 11' respectively. When the detachable portion 5 is secured on retaining element 12 by slipping slit 7 over the retaining element 12, it lifts the entire bag body 8 up high onto rack holder 10. The bag mouth 4 is now proximate to the brace 14. The elevation of bag 1 on the rack holder 10 may be seen to have improved the potential loading capacity of said bag 1 over what is possible with the prior art system described above.

In FIG. 3, the detachable portion 5 is shown adjacent to bag mouth 4 with centrally located transverse slit 7. Perforation line 9 is defined by scalloped cuts 21, 22, 23, 24, 25 and 26, with tit connections 28, 29, 30, 31, 32 and 33 located in between the scalloped cuts of said perforation lines. The tit connections 27, 28, 29, 30, 31, 32 and 33 point inward towards the center of the detachable portion 5 and away from the bag body 8. Upon separation of the detachable portion 5 from the bag body 8, said inwardly pointed tit connections will tear inwards towards the detachable portion 5 thus significantly reducing the possibility of tearing downwards into the bag body 8. The use of detachable portion 5 with its perforation line 9, which only tears inward, hence preserving the integrity of the bag body 8, is of significant importance. By contrast, the use of tabs, such as those of the U.S. Pat. No. 4,529,090 variety, are impractical for lifting the bag body upwards; and the use of traditional style straight-line perforations will leave the bag body 8 vulnerable to tearing.

In FIG. 4, plastic bag 31 has a bottom 32, two handles 33 and 33', a bag mouth 34, a body 38, and side gusset panels 41 and 41'. Bag mouth 34 extends substantially horizontally from the base 33*a* of handle 33 to the base 33*a*' of the handle 33'. Centrally located in the bag mouth 34 is detachable portion 35, which has a slit 37 within its perimeter, which perimeter is defined by perforation line 39 below and bag mouth 34 above. All of the foregoing are much the same as the bag style in FIGS. 1, 2 and 3. However, body apertures 36 and 36' are spaced laterally from detachable portion 35 and below handles 33 and 33' respectively. Body apertures 36 and 36' are cut through both front bag wall 56 and rear wall 55 (FIG. 6) of bag body 38 and through gusset panels 41 ad 41' respectively. Body apertures 36 and 36' may be in a variety of round, oval or straight line configurations but are generally preferred to be about ¼" wide by about 1⅜" long. It is also preferred to have them located about ¾" inside of the outer edges 40 and 40' of bag body 38, which coincides with being about ¾" inside the gusset panels 41 and 41' as well.

Figure 5:
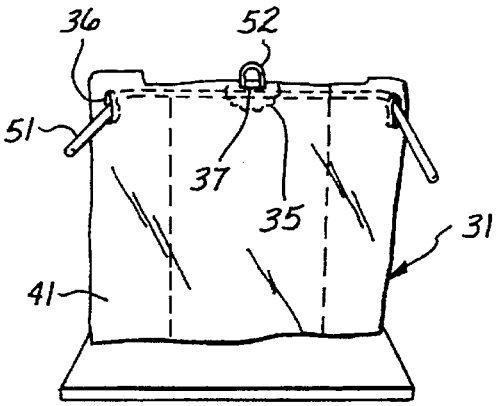
FIG. 5 is a front perspective view of the bag of FIG. 4 mounted on a rack holder.

In FIG. 5, bag 31 of FIG. 4 is shown mounted onto rack holder 50 (which holder is of the same style as that illustrated in FIG. 2) by passing the body apertures 36 and 36' onto rod supports 51 and 51' respectively and by slipping slit 37 over retaining element 52 to secure detachable portion 35 to rack holder 50. Visually, it can be seen that bag 31, when mounted on rack holder 50, lifts the entire bag body 38 high on said holder 50, even higher than the bag and system of FIGS. 1 and 2. It can be appreciated that the bag handles 33, 33' will lie neatly behind the rack holder 50 instead of protruding out sideways.

Figure 6:
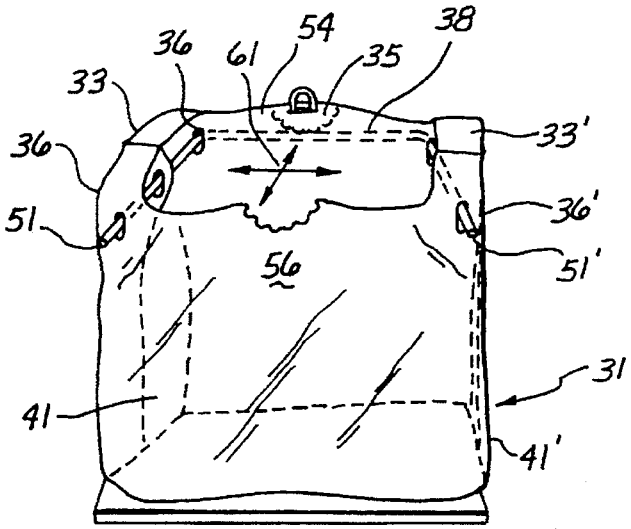
FIG. 6 is a front perspective view of the bag and rack holder of FIG. 5 with the forward-most bag opened and ready for loading.

In sequence from FIG. 5, as illustrated in FIG. 6, bag 31 is opened and ready for loading with rear bag mouth location 55 seen as being clearly proximate to and slightly above the brace 54 and rod supports 51 and 51'. In this open end position, front bag wall 56 has been separated from the detachable portion 35, and extended fully forward, thereby causing gusset panels 41 and 41', defined by dotted lines, to also expand fully forward and leave handles 33 and 33', laying atop rod supports 51 and 51' respectively. It will be appreciated that in this opened position, with front bag wall 56 extended fully forward, the bag mouth opening 61 is considerably enlarged and squared out over what is achievable in the prior art system. Through the enlarged bag mouth opening 62, the user has easier access to load merchandise into the available cube capacity within bag 31. Upon completion of the loading process, the user may readily locate the two handles 33 and 33' laying atop rod supports 51 and 51' respectively, and pull the bag 31 forward to separate the rear bag wall 55 from its detachable portion 35 along its perforation line 39.

Figure 7:
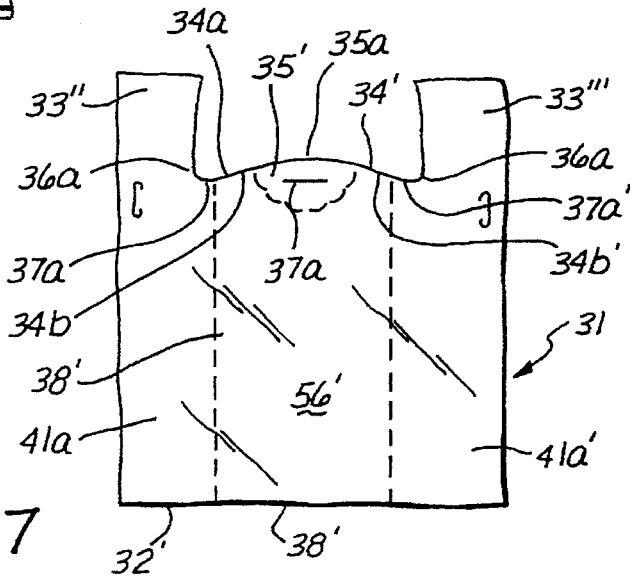
FIG. 7 illustrates a further embodiment of the invention.

The same result may be attained with the modified embodiment of the invention illustrated in FIG. 7. In this embodiment, the upper edge 34*a* of the bag mouth 34' and the upper edge 35*a* of the centrally detachable portion 35' do not lie in a substantially horizontal line, as in the embodiments of FIGS. 1 and 4–6, but are slightly arched from the intersection 36*a* of said edges 34*a* and the bag handles 33", 33'". The slit 37 then may be slightly above the lowermost section 37*a'* of said upper edges 34*a*, but will be below the sections 34*b*, 34*b'* of the edges 34*a* which abut the centrally detachable portions 35*a*. This slightly arched configuration of the upper edges 34*a* of the bag body 38' with the centrally detachable portion 35*a* and disposition of the slit 37*a* will not produce any different result from that attainable by the other embodiments of the invention.

What is claimed is:

1. In combination, a rack, said rack comprising a transverse support member and a pair of parallel rods extending horizontally forward from said support member, said rods being spaced apart from each other by a predetermined distance and disposed in a common horizontal plane; said rack further having an element disposed intermediate said rods and projecting upwardly above said common plane; and a pack of plastic T-shirt merchandise bags, each bag of the pack having front and rear panels, said panels being secured to each other along their bottom edges to form a closed bottom end and secured together along their side edges, said side edges terminating in bag handles spaced apart from each other and closed along the upper handle edges; an open bag mouth between the handles and defined by the upper inner edges of the panels, each of the said upper inner edges having a centrally detachable portion extending downwardly into its panel, said centrally detachable portion having a transverse slit, said slit being disposed at a level below the remaining portions of said upper inner edges adjacent the centrally detachable portion to receive the upwardly projecting rack element; each of said centrally detachable portions being adhered to adjacent centrally detachable portions of the pack; and each of the side edges of one of said panels having an orifice spaced apart from the orifice in the other side edge of the panel by said predetermined distance and said orifices being mounted on said rods;

whereby when the front panel of the forwardmost bag of the pack is pulled forward, it is detached from its detachable portion and forms an open bag mouth supported by the rods for loading the bag.

2. The combination as described in claim 1 wherein the orifices in the side edges of the panels are disposed in their respective handles.

3. The combination as described in claim 1 wherein the orifices in the sides edges of the panels are disposed below the bag handles.

4. The combination as described in claim 1 wherein the parallel rods extend horizontally forward for a distance exceeding the extent to which the bag mouth may be fully opened, whereby the insides of the handles are disposed against the rods for full open bag support to maximize the area of the mouth opening.

5. The combination as described in claim 1 wherein the detachable portion of the upper edge defining the bag mouth is itself defined by a series of scalloped cuts, the apexes of all said scalloped cuts define a curve extending symmetrically from one point on the upper edge to another point on the upper edge, said points being spaced apart from each other, with the base of each scalloped cut being joined to an adjacent base by a small rupturable bridge, thereby, upon the exertion of force to detach the detachable portion from its bag panel, any tearing will extend into the detachable portion and away from the remainder of the bag panel.

6. In combination, a rack, said rack comprising a transverse support member and a pair of parallel rods extending horizontally forward from said support member, said rods being spaced apart from each other by a predetermined distance and disposed in a common horizontal plane; said rack further having an element disposed intermediate said rods and projecting upwardly above said common plane; and a pack of plastic T-shirt merchandise bags each bag of the pack having front and rear panels, said panels being secured to each other along their bottom edges to form a closed bottom end, and secured together along their side edges, said side edges terminating in bag handles spaced apart from each other and closed along the upper handle edges; an open bag mouth between the handles defined by the upper inner edges of the panels, each of the said upper inner edges having a centrally detachable portion extending downwardly into its panel, said centrally detachable portion having a transverse slit, said slit being disposed at a level below the portions of said upper inner edges, which abut the centrally detachable portion, to receive the upwardly projecting rack element; each of said centrally detachable portions being adhered to adjacent centrally detachable portions of the pack; and each of the side edges of said panels having an orifice spaced apart from the orifice in the other edge of the side panel by said predetermined distance and said orifices being mounted on said rods;

whereby when the front panel of the forwardmost bag of the pack is pulled forward, it is detached from its detachable portion and forms an open bag mouth supported by the rods for loading of the bag.

* * * * *